US007121022B2

(12) United States Patent
Bierwith

(10) Patent No.: US 7,121,022 B2
(45) Date of Patent: Oct. 17, 2006

(54) CAM ACTION LOCKING ASSEMBLY

(75) Inventor: Robert Bierwith, Berkeley, CA (US)

(73) Assignee: Berkeley Forge and Tool, Inc., Berkeley, CA (US)

( * ) Notice: Subject to any disclaimer, the term of this patent is extended or adjusted under 35 U.S.C. 154(b) by 197 days.

(21) Appl. No.: 10/815,471

(22) Filed: Mar. 31, 2004

(65) Prior Publication Data

US 2005/0229443 A1 Oct. 20, 2005

(51) Int. Cl.
*E02F 9/28* (2006.01)

(52) U.S. Cl. ..... 37/455; 37/456; 37/458

(58) Field of Classification Search ..... 37/452–460, 37/468, 446; 172/772, 772.5, 749, 705, 713; 403/379.2, 379.4
See application file for complete search history.

(56) References Cited

U.S. PATENT DOCUMENTS 2,576,225 A * 11/1951 Hostetter ..... 37/459
2,618,873 A * 11/1952 Hostetter ..... 37/459
4,360,981 A 11/1982 Bierwith et al.
4,413,432 A 11/1983 Bierwith
4,570,365 A 2/1986 Bierwith
4,579,494 A 4/1986 Bierwith
5,052,134 A 10/1991 Bierwith
5,134,793 A 8/1992 Bierwith
5,417,518 A 5/1995 Bierwith
5,526,592 A 6/1996 Bierwith
5,564,206 A * 10/1996 Ruvang ..... 37/458
5,680,717 A 10/1997 Bierwith
5,681,127 A * 10/1997 Willen ..... 403/322.1
5,718,070 A * 2/1998 Ruvang ..... 37/459
5,913,605 A * 6/1999 Jusselin et al. ..... 37/451
5,992,063 A * 11/1999 Mack ..... 37/450
6,032,390 A 3/2000 Bierwith
6,108,950 A * 8/2000 Ruvang et al. ..... 37/452
6,151,812 A 11/2000 Bierwith
6,216,368 B1 4/2001 Bierwith
6,393,738 B1 5/2002 Bierwith
6,415,533 B1 7/2002 Bierwith
6,652,186 B1 11/2003 Bierwith
6,668,472 B1 12/2003 Bierwith
6,675,509 B1 1/2004 Bierwith
6,751,897 B1 6/2004 Bierwith
6,826,855 B1 * 12/2004 Ruvang ..... 37/450

FOREIGN PATENT DOCUMENTS

GB 2118616 * 11/1983

* cited by examiner

*Primary Examiner*—Thomas A. Beach
(74) *Attorney, Agent, or Firm*—Townsend and Townsend and Crew LLP

(57) ABSTRACT

A locking assembly is disclosed. The locking assembly is for coupling a first member including a receiving area, and a second member having a receiving region. The locking system includes an interference element including an interfering portion that is received within the receiving area of the first member when the locking system couples the first member and the second member together, a biasing element, a cam, wherein the cam is adapted to cause the biasing element to be in a biased position or an unbiased position, and a wedge shaped structure.

20 Claims, 6 Drawing Sheets

CAM ACTION LOCKING ASSEMBLY

BACKGROUND OF THE INVENTION

Excavation bucket assemblies are used in the construction and mining. The bucket assemblies are used with a variety of different excavating apparatuses such as backhoes, power shovels, front-end loaders, dragline equipment, etc. Excavation bucket assemblies typically have a bucket body with a rear wall, sidewalls, and a bottom wall. The walls cooperatively define a region where excavated material can be contained and moved. The bottom, front edge of the bucket body can be coupled to a lip. Tooth assemblies are coupled to the lip to form an excavation bucket assembly.

Each tooth assembly can include an adapter and a tooth. The adapter can be coupled to the lip and a tooth can be coupled to the adapter. Pins can be used to couple the parts of the tooth assembly together and can be used to couple the tooth assembly to the lip. When a tooth becomes worn or damaged, the pin coupling the tooth to its corresponding adapter can be removed so that the tooth can be uncoupled from the adapter. A new tooth is then mounted in the place of the worn or damaged tooth.

During the tooth replacement process, the pin is knocked out with a large hammer. If the pin is damaged during this process, it is replaced with a new pin. Frequently replacing broken pins is undesirable as doing so increases the cost of maintaining the excavation bucket assembly. Moreover, using a large hammer to remove a pin can be dangerous. When striking the pin with a hammer, flying debris such as metal chips and sand can be created. The flying debris can potentially harm persons in the vicinity of the hammering.

An improvement over the conventional pin-based coupling systems is described in U.S. Pat. No. 6,216,368 by the same inventor as the present invention. It discloses a wedge-locking system that couples an adapter and a tooth together without the use of pins. Other details about the wedge-locking system are described in the U.S. patent, which is herein incorporated by reference in its entirety for all purposes. The wedge-locking system is present in a depression in the adapter. In this example, the depression is in the form of a rectangle and is defined by four slightly raised walls.

Over a period of time, particles such as grit or sand can get into the depression and can abrade the parts of the wedge-locking system and the adapter. Accordingly, when the operator uncouples the adapter and the tooth, the operator also cleans the depression of sand and grit. If the operator does not clean the depression well, particles can remain in the depression. When the wedge-locking system is in use, the particles lodged in the depression can continue to abrade the parts of the wedge-locking system and the adapter. The abrasion reduces the useful life of the wedge-locking system and the adapter. More frequent replacement of the wedge-locking system parts and the adapter may be required.

Embodiments of the invention address these and other problems.

SUMMARY OF THE INVENTION

Embodiments of the invention are directed to locking assemblies, locking systems, and methods for use.

One embodiment of the invention is directed to a locking assembly for coupling a first member including a receiving area, and a second member having a receiving region, the locking system comprising: (a) an interference element including an interfering portion that is received within the receiving area of the first member when the locking system couples the first member and the second member together; (b) a biasing element; (c) a cam, wherein the cam is adapted to cause the biasing element to be in a biased position or an unbiased position; and (d) a wedge shaped structure, wherein the wedge shaped structure is configured to be received in the receiving region of the second member, and wherein movement of the wedge shaped structure in a first direction moves the interfering portion of the interference element into the receiving area of the first member and wherein movement of the wedge shaped structure in a second direction causes the interfering portion of the interference element to move out of the receiving area of the first member.

Another embodiment of the invention is directed to a locking system comprising: (a) a first member including a receiving area; (b) a second member including a receiving region; and (c) a locking assembly for coupling the first member and the second member having a receiving region wherein the locking assembly comprises (i) an interference element including an interfering portion that is received within the receiving area of the first member when the locking system couples the first member and the second member together, (ii) a biasing element, (iii) a cam, wherein the cam is adapted to cause the biasing element to be in a biased position or an unbiased position, and (iv) a wedge shaped structure, wherein the wedge shaped structure is configured to be received in the receiving region of the second member, and wherein movement of the wedge shaped structure in a first direction moves the interfering portion of the interference element into the receiving area of the first member and wherein movement of the wedge shaped structure in a second direction causes the interfering portion of the interference element to move out of the receiving area of the first member.

Another embodiment of the invention is directed to a method of using a locking system comprising: (a) obtaining a first member including a receiving area; (b) obtaining a second member including a receiving region; and (c) using a locking assembly to couple the first and second members together, wherein the locking assembly comprises (i) an interference element including an interfering portion that is received within the receiving area of the first member when the locking system couples the first member and the second member together, (ii) a biasing element, (iii) a cam, wherein the cam is adapted to cause the biasing element to be in a biased position or an unbiased position, and (iv) a wedge shaped structure, wherein the wedge shaped structure is configured to be received in the receiving region of the second member, and wherein movement of the wedge shaped structure in a first direction moves the interfering portion of the interference element into the receiving area of the first member and wherein movement of the wedge shaped structure in a second direction causes the interfering portion of the interference element to move out of the receiving area of the first member.

These and other embodiments are described in further detail below.

BRIEF DESCRIPTION OF THE DRAWINGS

In the Figures, like elements are designated by like reference numerals.

DETAILED DESCRIPTION

An embodiment of the invention is directed to a locking system including a first member including a receiving area and a second member including a receiving region. A locking assembly is used to couple the first member and the second member together. The locking assembly comprises (i) an interference element including an interfering portion that is received within the receiving area of the first member when the locking system couples the first member and the second member together, (ii) a biasing element, (iii) a cam, wherein the cam is adapted to cause the biasing element to be in a biased position or an unbiased position, and (iv) a wedge shaped structure, wherein the wedge shaped structure is configured to be received in the receiving region of the second member. The movement of the wedge shaped structure in a first direction moves the interfering portion of the interference element into the receiving area of the first member so that the locking assembly is in a locked position. Movement of the wedge shaped structure in a second direction causes the interfering portion of the interference element to move out of the receiving area of the first member so that the locking assembly is in an unlocked position.

Figure 1:
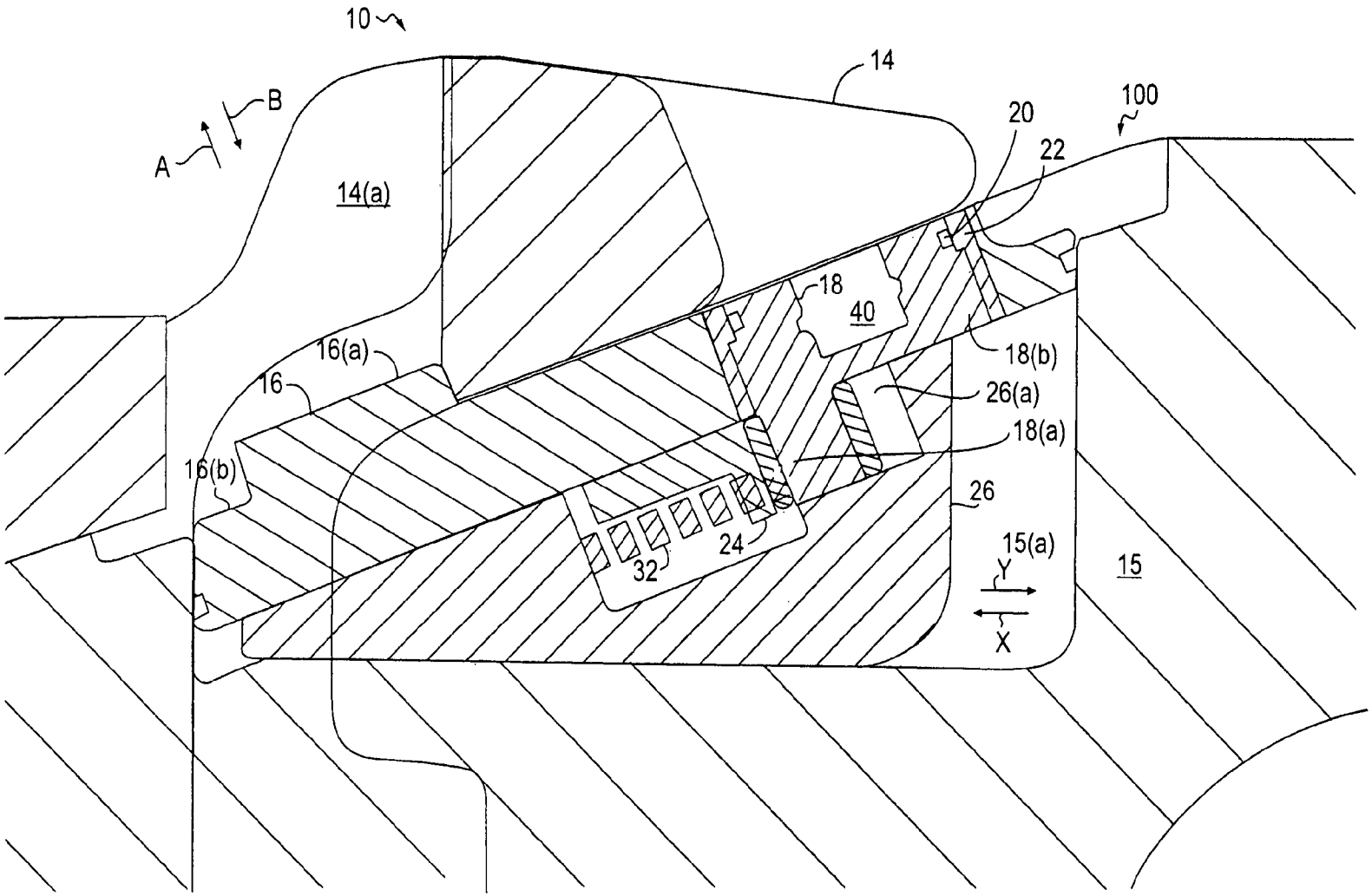
FIG. 1 shows a side cross-sectional view of a locking system according to an embodiment of the invention in a locked position.

FIG. 1 shows a side cross-sectional view of a locking system 10 according to an embodiment of the invention in a locked position. The locking system includes a first member 14 including a receiving area 14(*a*) and a second member 15 with a receiving region 15(*a*). The receiving area 14(*a*) may be in the form of a through aperture or a blind aperture, and may be any suitable size to receive an interfering portion of an interference member. The receiving region 15(*a*) can also be in any form (e.g., a through aperture, a blind aperture, a groove, a depression, etc.), and can be adapted to receive a wedge-shaped structure.

The first and second members 14, 15 may have any suitable form and can be made of any suitable material. Preferably, the first and second members 14, 15 are made of steel. In preferred embodiments, the first member 14 is a tooth and the second member 15 is an adapter for the tooth. The adapter can attach to a lip, which is attached to an excavation bucket structure or a large shovel. In other embodiments, the second member 15 could even be a lip structure or other body to which teeth can be attached. In yet other embodiments, the first member could be a cleat to a compactor wheel, while the second member is a part of the compactor wheel. Lip assemblies and compactor wheels are respectively described in U.S. Pat. No. 6,652,186 and U.S. patent application Ser. No. 10/054,332, filed on Nov. 13, 2001, which are herein incorporated by reference in their entirety for all purposes.

A locking assembly 100 couples the first and second members 14, 15 together or uncouples them from each other. The locking assembly 100 can include a number of parts that are readily separated from each other or it can be in the form of a unitary object whereby the internal parts are not easily separated from each other.

The locking assembly 100 includes an interference element 16, which has an interference portion 16(*a*) that extends outward from a major surface of a main portion 16(*b*). This interference portion 16(*a*) moves up into the receiving region 14(*a*) or out of the receiving region 14(*a*) to engage or disengage the interference element 16. The interference portion 16(*a*) of the interference element 16 can be shaped as a cylinder, block, etc.

The interference element 16 interacts with a rotating cam 18, which includes a pin 18(*a*) and a main portion 18(*b*) from which the pin 18(*a*) extends. The pin 18(*a*) of the cam 18 pushes a plunger 14, which interacts with a biasing element 32. As shown, the biasing element 32 is in a biased position. Suitable biasing elements include springs, compressible rubber, etc. An o-ring 20 and a bushing 22 may be disposed around the main portion 18(*b*) of the cam 18. The main portion 18(*b*) also includes a recess 40 which can receive a keying element (not shown) which allows a person to turn and rotate the cam 18.

A wedge shaped structure 26 is in the receiving region 15(*a*) and moves in the directions indicated by the arrows X and Y. The wedge shaped structure includes a recess 26(*a*), which receives the biasing element 32, the plunger 24, and the pin 18(*a*).

In some embodiments, the locking assembly 100 can be a unitary object with a sealing portion (not shown in FIG. 1), which can help seal and protect the internal components of the locking assembly 100. The sealing portion can comprise an elastomeric or elastic material such as rubber. This allows the internal parts of the locking assembly 100 to remain free of dirt and debris, while allowing the interference portion 16(*a*) of the interference element 16 to engage the first member 14.

In operation, a user uses a keying element (not shown) and inserts it into the recess 40 and then turns it clockwise or counterclockwise. This rotates the cam 18 and also the pin 18(*a*) of the cam 18. The pin 18(*a*) then pushes the plunger 14, which compresses the biasing element 32. As the plunger 24 and the biasing element 32 move toward the narrow end of the wedge shaped structure 26, the wedge shaped structure 26 moves in that direction as well (i.e., in a first direction X). The movement of the wedge shaped structure 26 causes the interference element 16 to move upward so that the interference portion 16(*a*) is in and stays in the receiving area 14(*a*) of the first member 14. Consequently, the first and second members 14, 15, are coupled together and the locking assembly is in a locked position.

Figure 2:
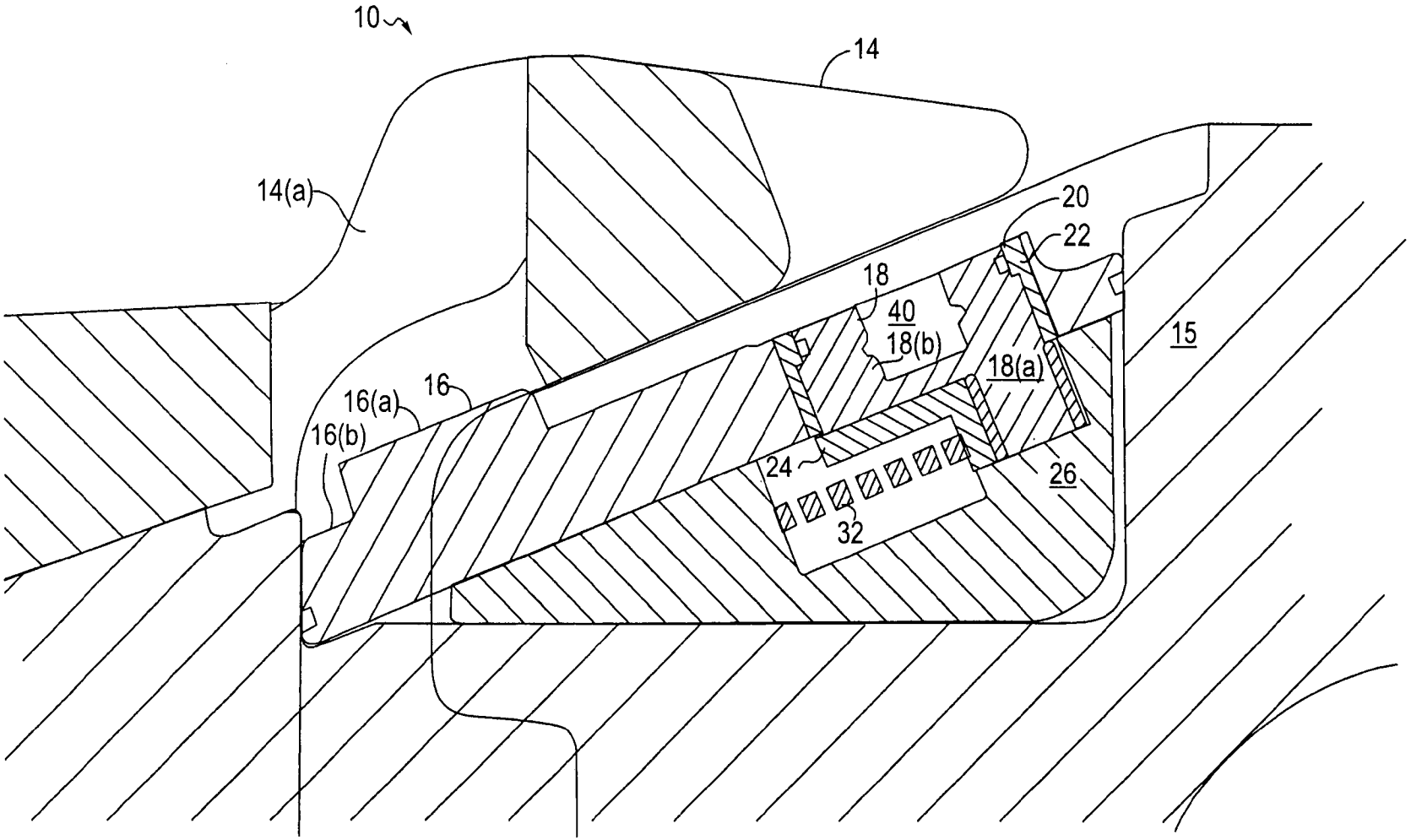
FIG. 2 shows a side cross-sectional view of a locking system according to an embodiment of the invention in an unlocked position.

Referring to FIG. 2, to uncouple the first and second members 14, 15 from each other, the cam 18 is turned so that the pin 18(*a*) moves away from the narrow end of the wedge shaped structure 26. This causes the wedge shaped structure 26 to move away from the first member 14 (i.e., in a second direction Y in FIG. 1). The interference element 16 then moves down (as a result of gravity) and the interference portion 16(*a*) is removed from the receiving area 14(*a*) of the first member 14. The first and second members can then be separated from each other.

As illustrated by this example, no coupling pins are needed and the locking apparatus operates in a simple way. In order to couple and uncouple first and second members, a user need only rotate the cam 18. This allows for rapid coupling and uncoupling of the first and second members.

Figure 3:
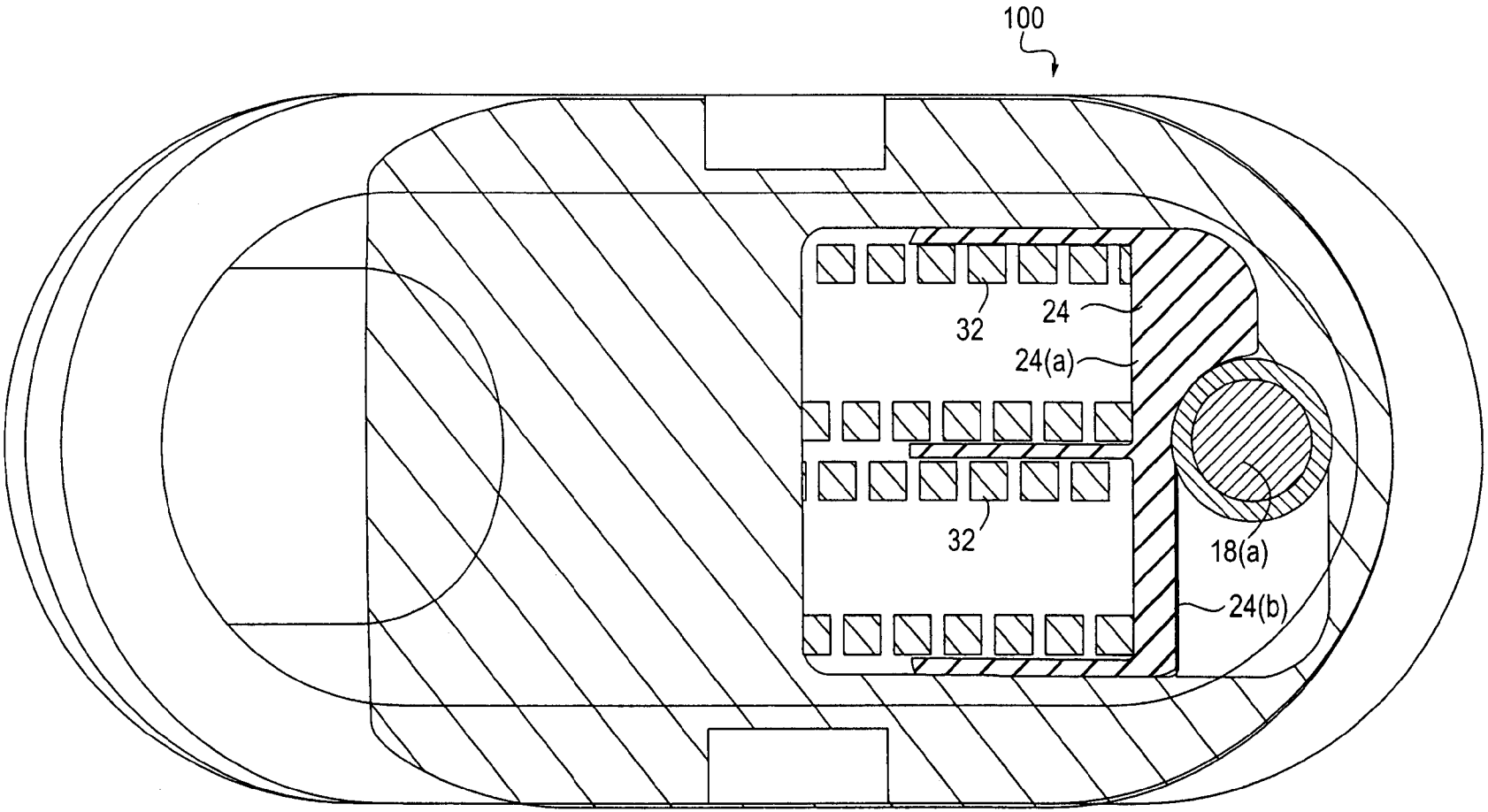
FIG. 3 shows a top cross-sectional view of a locking assembly according to an embodiment of the invention.

FIG. 3 shows a top plan cross-sectional view of a locking apparatus. As shown, the pin 18(*a*) (which may have a sheath around it) of the cam contacts the plunger 24. The plunger 24 has a first side 24(*a*) and a second side 24(*b*). The second side 24(*a*) contacts the pin 18(*b*) and has a curved surface, which is cooperatively structured with respect to the outer surface of the pin 18(*a*). The first side 24(*a*) of the plunger 24 has two cavities, which respectively contain two biasing elements 32. The plunger 24 can be made of stainless steel. Although two biasing elements are shown, there could be any number of biasing elements in other embodiments of the invention.

Figure 4:
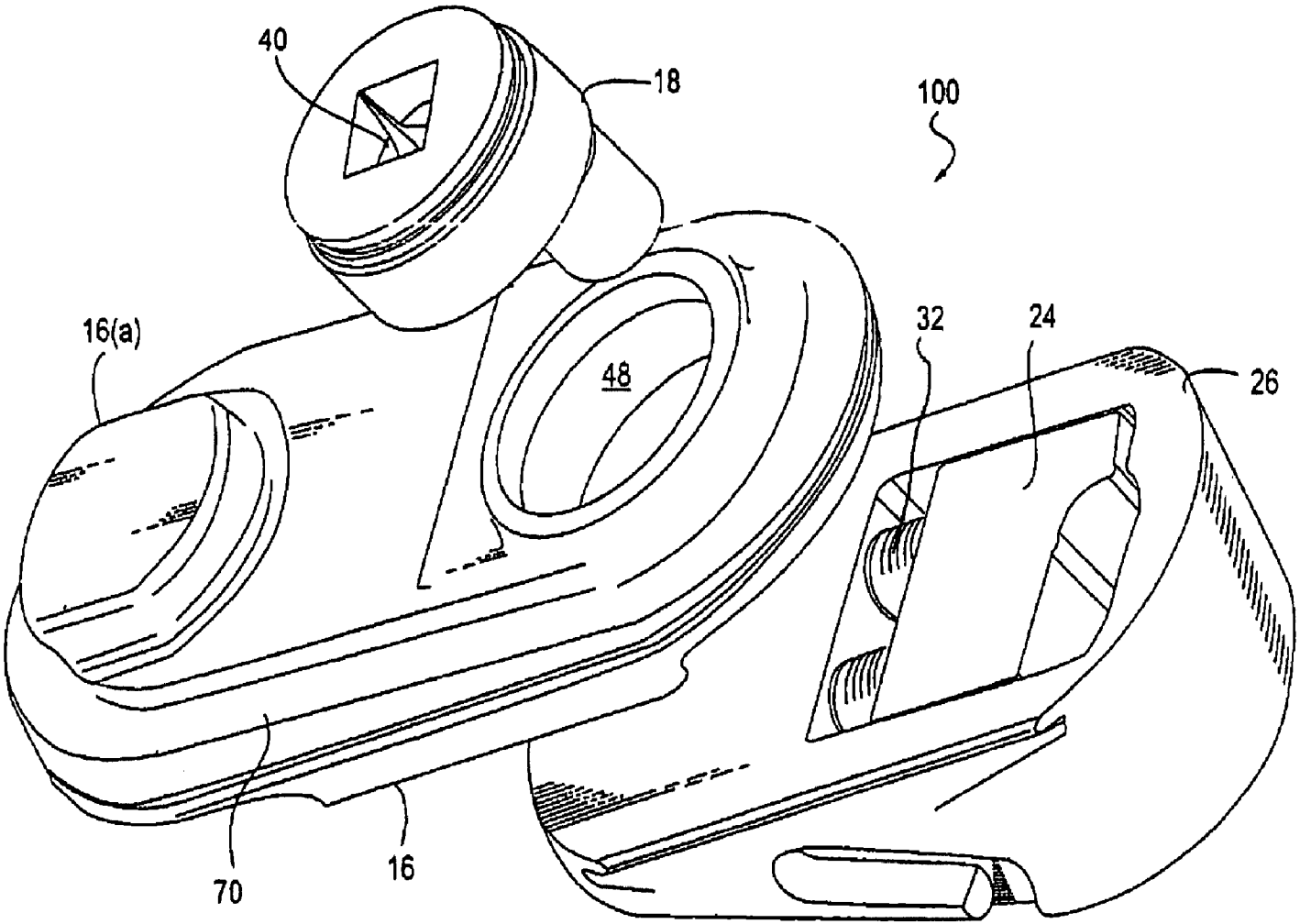
FIG. 4 shows an exploded view of a locking assembly according to an embodiment of the invention.

FIG. 4 shows an exploded perspective view of some components of a locking assembly. As shown, the cam 18 is received in an aperture 48 in the interference element 16. The interference element 16 can include a sealing portion 70 comprising an elastomeric or elastic material such as rubber. This sealing portion 70 can extend around the circumference of the oblong interference element 16 so that when the locking assembly is in the receiving region of a member, it can seal the receiving region so that debris does not pass into the receiving region. The sealing portion 70 can have a shape similar to the region defining the receiving region of the second member. The interference portion 16(*a*) is within the sealing portion 70 and can move up and down. It is possible to bond the sealing portion 70 to the outer edges interference portion 16(*a*) with an adhesive or the like so that the internal components of the locking assembly are protected from grit, dirt, etc. When it is put together, the locking assembly can be one unitary object, or can be in the form of separable pieces.

Figure 5:
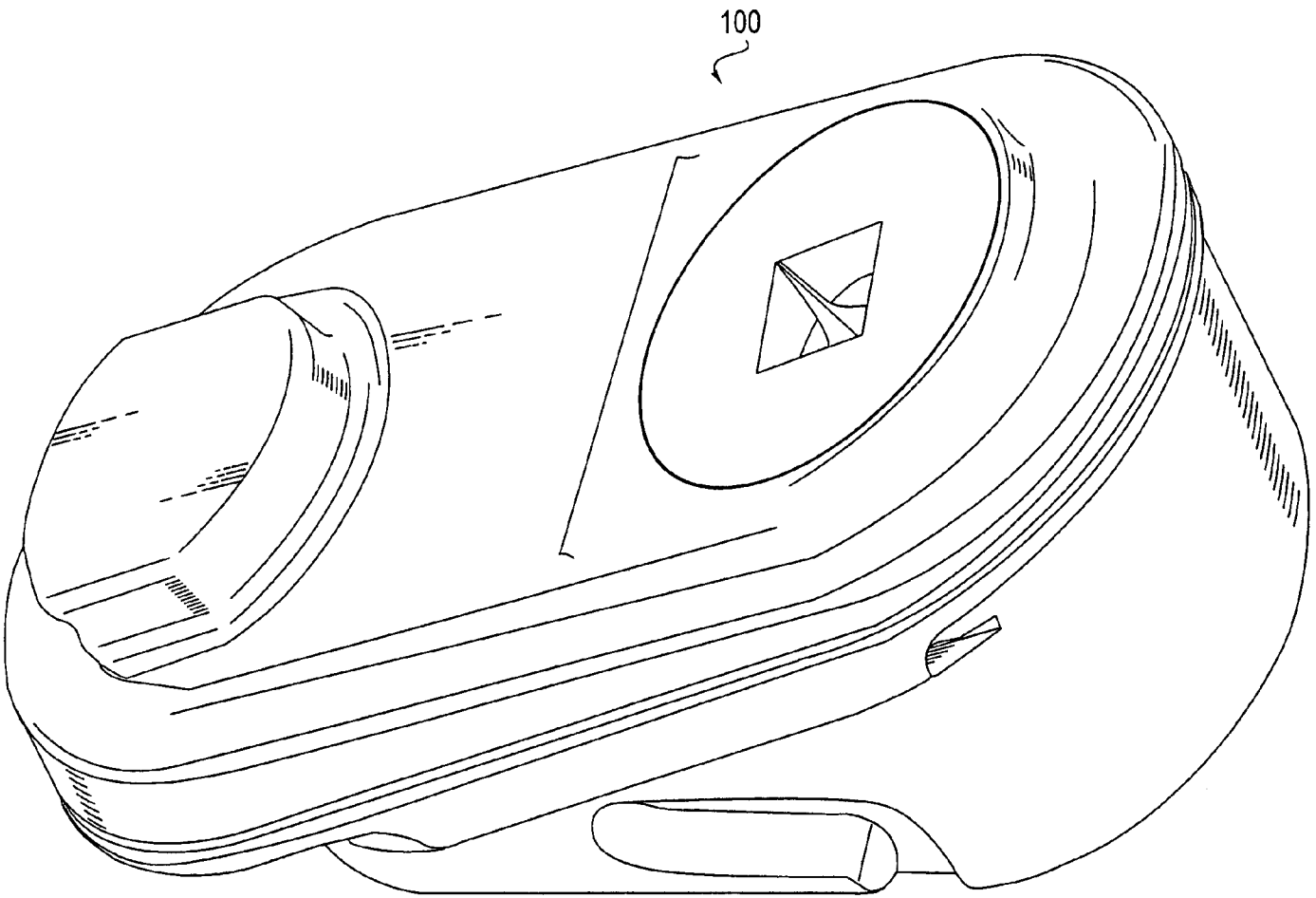
FIG. 5 shows a perspective view of a locking assembly according to an embodiment of the invention.

FIG. 5 shows a locking assembly 100 in the form of a unitary object, which can be received in the receiving region of a second member. The locking assembly 100 is wedge shaped and can be placed in a receiving region of a member such as an adapter.

Figure 6:
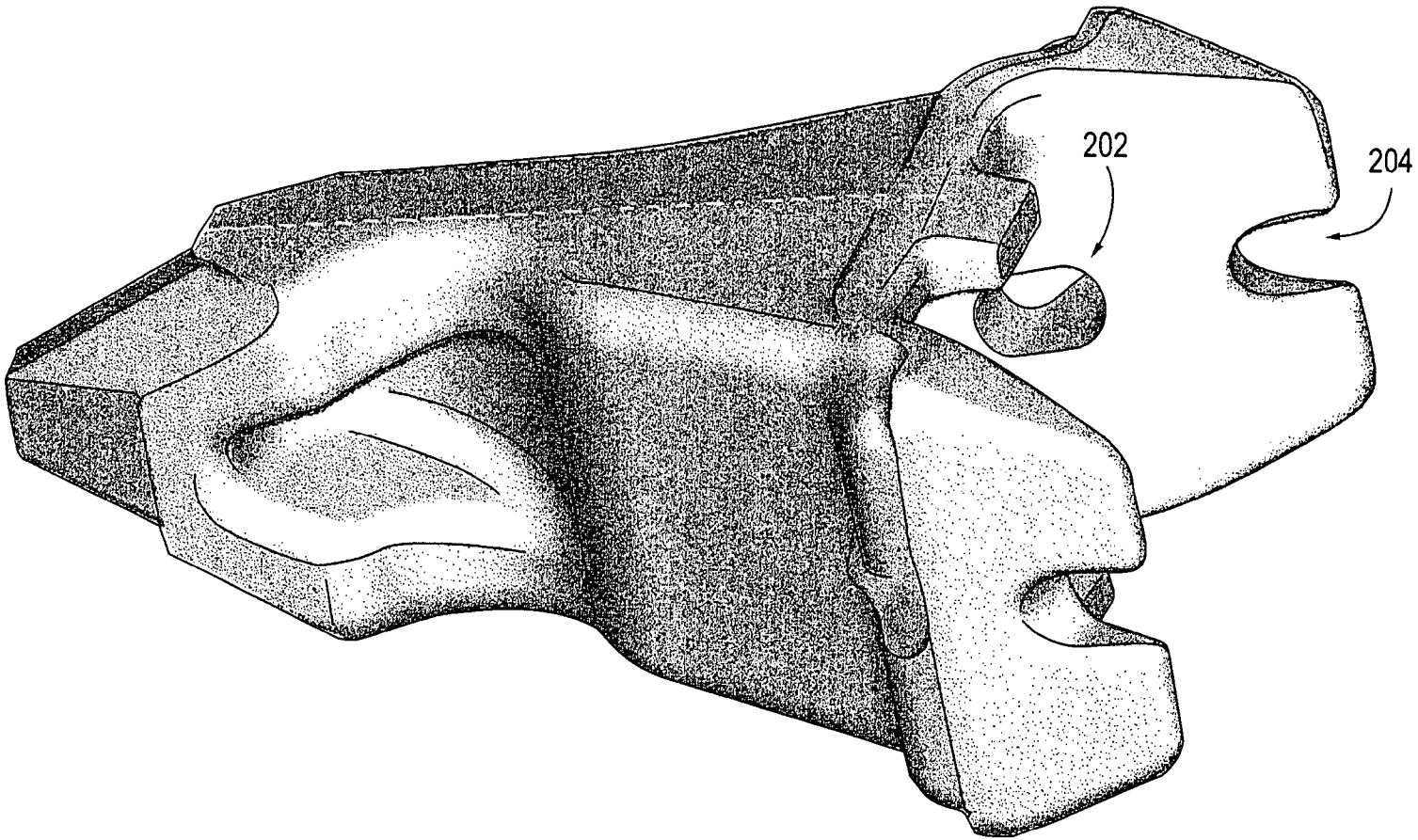
FIG. 6 shows a perspective view of a tooth.

FIG. 6 shows a perspective view of a tooth. As noted above, the tooth is an exemplary first member. A tooth like the one shown in FIG. 6 can be used with excavation buckets, shovels, etc. The tooth includes a first aperture 202, which can form a receiving area for an interference portion. The tooth may also include a partial aperture 204, which can allow a user to access the cam in the locking apparatus.

Embodiments of the invention have a number of advantages. First, the operation of the locking apparatus and system is simple. A user can quickly and easily uncouple and couple any two members by simply turning a cam. This results in improved productivity. Second, in the embodiments, which include a sealing portion such as an elastomeric or elastic material, the locking apparatus is sealed so that sand, dirt and other foreign particles cannot interfere with the moving parts of the locking system. This increases the operating life of the locking system. These advantages make the locking apparatus and systems according to embodiments of the invention less expensive in the long run, since they will not degrade as quickly.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed. Moreover, any one or more features of any embodiment of the invention may be combined with any one or more other features of any other embodiment of the invention, without departing from the scope of the invention.

All references, patent applications, and patents mentioned above are herein incorporated by reference in their entirety for all purposes. None of them are admitted to be prior art to the presently claimed inventions.

What is claimed is:

1. A locking assembly for coupling a first member including a receiving area, and a second member having a receiving region, the locking system comprising:

(a) an interference element including an interfering portion that is received within the receiving area of the first member when the lacking system couples the first member and the second member together;

(b) a biasing element;

(c) a cam, wherein the cam is adapted to cause the biasing element to be in a biased position or ax unbiased position; and (d) a wedge shaped structure, wherein the wedge shaped structure is configured to be received in the receiving region of the second member, and wherein movement of the wedge shaped structure in a first forward direction moves the interfering portion of the interference element upward into the receiving area of the first member and wherein movement of the wedge shaped structure in a second backward direction causes the interfering portion of the interference element to move downward out of the receiving area of the first member.

2. The locking assembly of claim 1 wherein the first member is a tooth and the second member is an adapter.

3. A locking assembly for coupling a first member including a receiving area, and a second member having a receiving region, the locking system comprising:

(a) an interference element including an interfering portion that is received within the receiving area of the first member when the locking system couples the first member and the second member together;

(b) a biasing element;

a cam, wherein the cam is adapted to cause the biasing element to be in a biased position or an unbiased position; and (d) a wedge shaped structure, wherein the wedge shaped structure is configured to be received in the receiving region of the second member, and wherein movement of the wedge shaped structure in a first direction moves the interfering portion of the interference element into the receiving area of the first member and wherein movement of the wedge shaped structure in a second direction causes the interfering portion of the interference element to move out of the receiving area of the first member, wherein the cam includes a main portion including a recess and a pin coupled to the main portion.

4. A locking assembly for coupling a first member including a receiving area, and a second member having a receiving region, the locking system comprising:

(a) an interference element including an interfering portion that is received within the receiving area of the first member when the locking system couples the first member and the second member together;

(b) a biasing element;

(c) a cam, wherein the cam is adapted to cause the biasing element to be in a biased position or an unbiased position; and (d) a wedge shaped structure, wherein the wedge shaped structure is configured to be received in the receiving region of the second member, and wherein movement of the wedge shaped structure in a first direction moves the interfering portion of the interference element into the receiving area of the first member and wherein movement of the wedge shaped structure in a second direction causes the interfering portion of the interference element to move out of the receiving area of the first member, further comprising a plunger between the biasing element and a portion of the wedge shaped structure.

5. A locking assembly for coupling a first member including a receiving area, and a second member having a receiving region, the locking system comprising:

(a) an interference element including an interfering portion that is received within the receiving area of the first member when the locking system couples the first member and the second member together;

(b) a biasing element;

(c) a cam, wherein the cam is adapted to cause the biasing element to be in a biased position or an unbiased position; and (d) a wedge shaped structure, wherein the wedge shaped structure is configured to be received in the receiving region of the second member, and wherein movement of the wedge shaped structure in a first direction moves the interfering portion of the interference element into the receiving area of the first member and wherein movement of the wedge shaped structure in a second direction causes the interfering portion of the interference element to move out of the receiving area of the first member, wherein the interference element includes a sealing portion.

6. A locking assembly for coupling a first member including a receiving area, and a second member having a receiving region, the locking system comprising:

(a) an interference element including an interfering portion that is received within the receiving area of the first member when the locking system couples the first member and the second member together;

(b) a biasing element;

(c) a cam, wherein the cam is adapted to cause the biasing element to be in a biased position or an unbiased position; and (d) a wedge shaved structure, wherein the wedge shaped structure is configured to be received in the receiving region of the second member, and wherein movement of the wedge shaped structure in a first direction moves the interfering portion of the interference element into the receiving area of the first member and wherein movement of the wedge shaped structure in a second direction causes the interfering portion of the interference element to move out of the receiving area of the first member, further comprising an o-ring around a main portion of the cam.

7. A locking system comprising:

(a) a first member including a receiving area;

(b) a second member including a receiving region; and (c) a locking assembly for coupling the first member and the second member having a receiving region, wherein the locking system comprises (i) an interference element including an interfering portion that is received within the receiving area of the first member when the locking assembly couples the first member and the second member together, (ii) a biasing element, (iii) a cam, wherein the cam is adapted to cause the biasing element to be in a biased position or an unbiased position, and (iv) a wedge shaped structure, wherein the wedge shaped structure is configured to be received in the receiving region of the second member, and wherein movement of the wedge shaped structure in a first forward direction moves the interfering portion of die interference element upward into the receiving area of the first member and wherein movement of the wedge shaped structure in a second backward direction causes the interfering portion of the interference element to move downward out of the receiving area of the first member.

8. The locking system of claim 7 wherein the first member is a tooth and the second member is an adapter.

9. The locking system of claim 7 wherein the cam includes a main portion including a recess and a pin coupled to the main portion.

10. The locking system of claim 7 comprising a plunger between the biasing element and a portion of the wedge shaped structure.

11. The locking assembly of claim 7 wherein the interference element includes a sealing portion.

12. The locking assembly of claim 7 further comprising an o-ring around a first portion of the cam.

13. A method of using a locking system comprising:

(a) obtaining a first member including a receiving area;

(b) obtaining a second member including a receiving region; and (c) using a locking assembly to couple the first and second members together, wherein the locking assembly comprises (i) an interference element including an interfering portion that is received within the receiving area of the first member when the locking system couples the first member and the second member together, (ii) a biasing element, (iii) a cam, wherein the cam is adapted to cause the biasing element to be in a biased position or an unbiased position, and (iv) a wedge shaped structure, wherein the wedge shaped structure is configured to be received in the receiving region of the second member, and wherein movement of the wedge shaped structure in a first forward direction moves the interfering portion of the interference element upward into the receiving area of the first member and wherein movement of the wedge shaped structure in a second backward direction causes the interfering portion of the interference element to move downward out of the receiving area of the first member.

14. The method of claim 13 wherein the first member is a tooth and the second member is an adapter.

15. The method of claim 13 wherein the cam includes a main portion including a recess and a pin coupled to the main portion.

16. The method of claim 13 comprising a plunger between the biasing element and a portion of the wedge shaped structure.

17. The method of claim 13 wherein the interference element includes a sealing portion.

18. The method of claim 13 further comprising an o-ring around a first portion of the cam.

19. A locking system comprising:

the locking assembly of claim 3;

the first member, wherein the first member is a tooth; and the second member, wherein the second member is an adapter, and wherein the first member and the second member are secured together with the locking assembly.

20. A locking system comprising:

the locking assembly of claim 4;

the first member, wherein the first member is a tooth; and the second member, wherein the second member is an adapter, and wherein the first member and the second member are secured together with the locking assembly.

* * * * *

UNITED STATES PATENT AND TRADEMARK OFFICE

CERTIFICATE OF CORRECTION

PATENT NO. : 7,121,022 B2
APPLICATION NO. : 10/815471
DATED : October 17, 2006
INVENTOR(S) : Robert Bierwith It is certified that error appears in the above-identified patent and that said Letters Patent is hereby corrected as shown below:

In Column 6, claim 1, line 37 kindly change “lacking” to --locking--

In Column 6, claim 1, line 41 kindly change “ax” to --an--

In Column 8, claim 6, line 1 kindly change “shaved” to --shaped--

In Column 8, claim 7, line 29 kindly change “die” to --the--

Signed and Sealed this

Ninth Day of January, 2007

JON W. DUDAS
*Director of the United States Patent and Trademark Office*